US009187885B2

(12) United States Patent
Schulze

(10) Patent No.: US 9,187,885 B2
(45) Date of Patent: Nov. 17, 2015

(54) PLUMBING FIXTURE AND SYSTEM

(71) Applicant: Michael Schulze, Newport Beach, CA (US)

(72) Inventor: Michael Schulze, Newport Beach, CA (US)

(73) Assignee: MDS TECHNOLOGIES, LLC, San Diego, CA (US)

( * ) Notice: Subject to any disclaimer, the term of this patent is extended or adjusted under 35 U.S.C. 154(b) by 317 days.

(21) Appl. No.: 13/663,620

(22) Filed: Oct. 30, 2012

(65) Prior Publication Data

US 2014/0115776 A1 May 1, 2014

(51) Int. Cl.
*E03C 1/12* (2006.01)
*E03C 1/232* (2006.01)
*E03C 1/262* (2006.01)

(52) U.S. Cl.
CPC ..... *E03C 1/232* (2013.01); *E03C 1/262* (2013.01)

(58) Field of Classification Search
CPC ..... E03C 1/22; E03C 1/23; E03C 1/232; E03C 1/2302; E03C 1/2304; E03C 1/2306; E03C 1/262; E03C 1/242
USPC ..... 4/679–686, 688–693
See application file for complete search history.

(56) References Cited

U.S. PATENT DOCUMENTS 1,776,385 A * 9/1930 Hoelscher ..... 4/692
1,867,725 A * 7/1932 Brotz ..... 4/584
1,980,493 A * 11/1934 Morisseau ..... 4/685
1,994,789 A 3/1935 Redmond et al.
2,059,120 A * 10/1936 Kreuzer et al. ..... 4/685
2,063,632 A * 12/1936 Schneider ..... 4/689
2,337,331 A 12/1943 Kirschner (Continued)

FOREIGN PATENT DOCUMENTS

WO WO2009/126439 10/2009

OTHER PUBLICATIONS

U.S. Appl. No. 29/436,419, filed Nov. 6, 2012, Schulze.

(Continued)

*Primary Examiner* — Lauren Crane
*Assistant Examiner* — Erin Deery
(74) *Attorney, Agent, or Firm* — John J. Connors; Connors & Assoc. pc

(57) ABSTRACT

A plumbing system includes a tub having a drain fixture lodged within a floor drain opening. The drain fixture comprises a body member beneath the floor and a drain cap member inserted into an exposed open inlet of the body member. The body member has a passageway extending between the open inlet and a downstream open outlet in communication with a sewer. A pipe connected to the body member between the inlet and outlet has one end in communication with the passageway and another end in communication with an overflow opening in the tub above the drain opening to vent the passageway. The drain cap member moves between a first position allowing liquid to flow through the passageway and a second position preventing the flow of liquid through the passageway.

9 Claims, 8 Drawing Sheets

(56) References Cited

U.S. PATENT DOCUMENTS

| | | | | |
|---|---|---|---|---|
| 4,120,312 | A * | 10/1978 | Michael | 4/431 |
| 4,380,834 | A * | 4/1983 | Wentz | 4/287 |
| 5,381,831 | A * | 1/1995 | Versland | 137/868 |
| 5,509,150 | A | 4/1996 | Bergmann et al. | |
| 6,058,525 | A | 5/2000 | Paden | |
| 6,138,297 | A | 10/2000 | Harris et al. | |
| 6,484,330 | B2 | 11/2002 | Gray et al. | |
| 7,941,878 | B1 | 5/2011 | Truong | |
| 8,782,824 | B2 | 7/2014 | Shoop et al. | |
| 2004/0034926 | A1* | 2/2004 | Ball | 4/680 |
| 2007/0039098 | A1 | 2/2007 | Ball | |
| 2013/0180045 | A1* | 7/2013 | Ball et al. | 4/680 |

OTHER PUBLICATIONS

U.S. Appl. No. 29/454,914, filed May 15, 2013, Schulze.

Search Report Written Opinion of PCTUS2014/26832, Mar. 13, 2014, Schulze.

The Keeney Manufacturing Company & Duracraft Plastics, Roller Ball Plastic Triad Bath Drain, copy of packaging bag, 3 pages capturing printed material on packaging bag 2013.

* cited by examiner

PLUMBING FIXTURE AND SYSTEM

INCORPORATION BY REFERENCE

Any and all U.S. patents, U.S. patent applications, and other documents, hard copy or electronic, cited or referred to in this application are incorporated herein by reference and made a part of this application.

DEFINITIONS

The words "comprising," "having," "containing," and "including," and other forms thereof, are intended to be equivalent in meaning and be open-ended in that an item or items following any one of these words is not meant to be an exhaustive listing of such item or items, or meant to be limited to only the listed item or items.

The word "cable system" includes any flexible and elongated cord, string, rope or like device employing one or multiple strands of material.

The word "perforated" means having an opening.

The words "substantially" and "essentially" have equivalent meanings.

The word "tub" means any open container for holding a sufficient volume of water to at least partially immersed oneself in the water, for example, wash basins, shower stalls, step-in bathtubs, walk-in bathtubs, sinks, and the like.

INCORPORATION BY REFERENCE

Any and all U.S. patents, U.S. patent applications, and other documents, hard copy or electronic, cited or referred to in this application are incorporated herein by reference and made a part of this application.

BACKGROUND

A typical tub has a floor in which a drain opening is in communication through a plumbing drain line with a sewer. A drain cap member is inserted into the drain opening to close the opening and prevent water from escaping from the tub, and lifted from the drain opening to allow water to flow through the drain opening into the sewer. The rate at which the water flows from the tub is usually from 10.5 to 15 gallons per minute for most household applications. This drain time is unacceptable is undesirably for some applications, for example, walk-in bathtubs holding substantially from 55 to 125 gallons of water.

SUMMARY

My plumbing fixture and system enables tubs to be drained much faster than prior art systems such as depicted in FIG. 1A. My plumbing fixture and system have one or more of the features depicted in the embodiments discussed in the section entitled "DETAILED DESCRIPTION OF ONE ILLUSTRATIVE EMBODIMENT." The claims that follow define my plumbing fixture and system, distinguishing them from the prior art; however, without limiting the scope of my plumbing fixture and system as expressed by these claims, in general terms, some, but not necessarily all, of their features are:

One, my plumbing drain fixture comprises a body member including a passageway extending between an open inlet and an open outlet, and a pipe connected to the body member between the inlet and outlet and in communication with the passageway. The body member and pipe may be an integral, one-piece, unitary structure molded from a plastic. The body member has a central longitudinal reference line intersecting the inlet and outlet, and the pipe may be substantially at a right angle to the body member's central longitudinal reference line. A drain cap member is adapted to be inserted into the open inlet. The drain cap member includes a solid cover and a wall member forms a body of the cap member with at least one opening therein. In one embodiment the wall is perforated with small diameter apertures that act to prevent items from entering the drain outlet even when the cap member is in the open condition. Thus expensive jewelry or other items cannot enter the drain outlet. The drain cap member may be an integral, one-piece, unitary structure of cast metal. The wall member extends from an underside of the solid cover into the passageway upon insertion of the drain cap member into the body member. The drain cap member may include an adjustment mechanism to compensate for dimensional errors, and it is detached and free to be manually lifted from a drain opening. Upon insertion of the drain cap member, the cap member's wall member has a central longitudinal reference line that is substantially co-extensive with the body member's central longitudinal reference line.

Two, the inlet of the passageway may be cylindrical and has an internal thread. Screwed into this passageway is a cylindrical collar member with an externally threaded surface at an open entrance end, the body member and the collar member being separate components. The entrance end has a predetermined inside diameter, and the collar member has an open exit end opposed to the entrance end. The externally threaded surface and internal thread of the body member are adapted to be screwed together at the inlet of the body member upon attachment of the fixture to a drain opening in a floor of a tub. The drain cap member is inserted into the body member through the collar member screwed to the body member. The wall member has a predetermined diameter substantially equal to the predetermined inside diameter of the collar member yet with sufficient clearance for the drain cap member to move between a first position allowing liquid to flow through the opening into the passageway and a second position preventing the flow of liquid. The collar member may include a thin, circumferential lip that is substantially flush with the floor upon screwing the collar member and body member together with connection of the fixture to a drain opening.

Three, a drain cap member actuator for the drain cap member enables a user while in the tub to raise and lower the drain cap member. The drain cap member actuator has a portion thereof in the passageway and engaging the drain cap member upon inserting the drain cap member into the passageway and another portion engaging a manual actuator accessible to a user while in the tub. The drain cap member actuator may be mounted to the body member to move the drain cap member between first and second positions, and it may include a cable system having a handle that a user turns. The wall member of the drain cap member fits snug within the inlet yet with sufficient clearance for the drain cap member to move between a first position allowing liquid to flow through the opening and passageway and a second position preventing the flow of liquid.

These features are not listed in any rank order nor is this list intended to be exhaustive.

DESCRIPTION OF THE DRAWING

One embodiment of my plumbing fixture and system is discussed in detail in connection with the accompanying drawing, which is for illustrative purposes only. This drawing includes the following figures (Figs.), with like numerals indicating like parts.

DESCRIPTION OF PRIOR ART

Figure 1A:
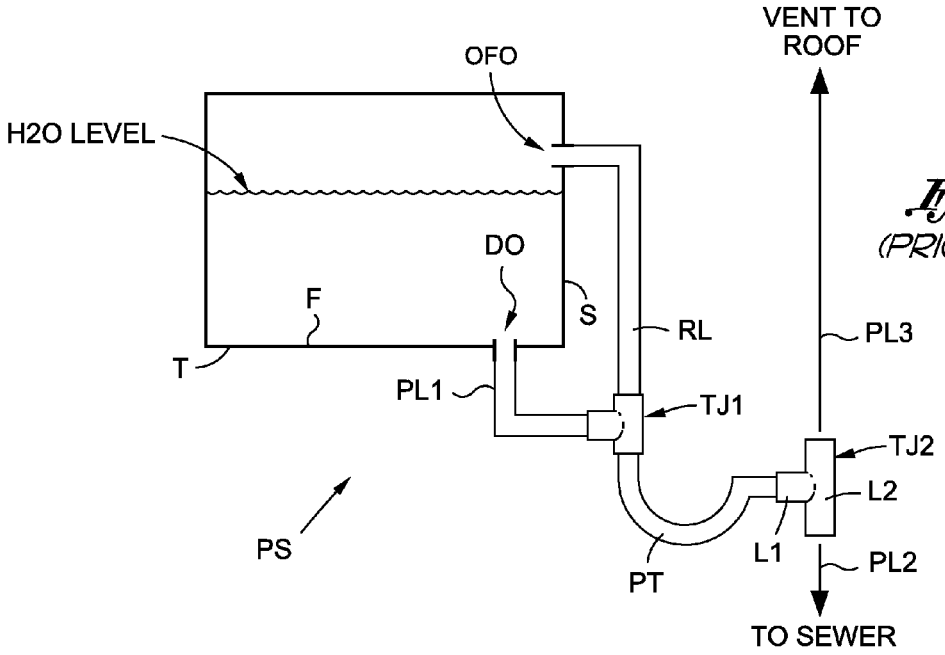
Fig. 1A (PRIOR ART)
FIG. 1A is a schematic diagram illustrating a prior art plumbing system for a tub.

As depicted in FIG. 1A, a conventional plumbing system PS includes a tub T typically having in its floor F a drain opening DO, and in a side S of the tub an overflow opening OFO above the drain opening. If the water ($H_2O$) level in the tub T reaches the overflow opening OFO, overflow water flows through this overflow opening into an inlet of a return line RL. A plumbing line PL1 has its inlet at the drain opening DO and its outlet in communication through a T-joint TJ1 with an inlet of a downstream P-trap PT. An outlet of the return line RL is connected through the T-joint TJ1 to the inlet of the downstream P-trap PT. An outlet of the P-trap is connected to one leg L1 of a T-joint TJ2 and opposed ends of a cross-leg L2 of the T-joint are respectively in communication through plumbing lines PL2 and PL3 with a sewer and a vent to a roof of a building housing the conventional plumbing system PS. This piping configuration places the overflow opening OFO in fluid communication with the sewer through the P-trap PT, so overflow water exiting the tub T through the overflow opening OFO flows into the P-trap as does water exiting the tub through the drain opening DO.

DETAILED DESCRIPTION OF ONE ILLUSTRATIVE EMBODIMENT

General

Figure 1B:
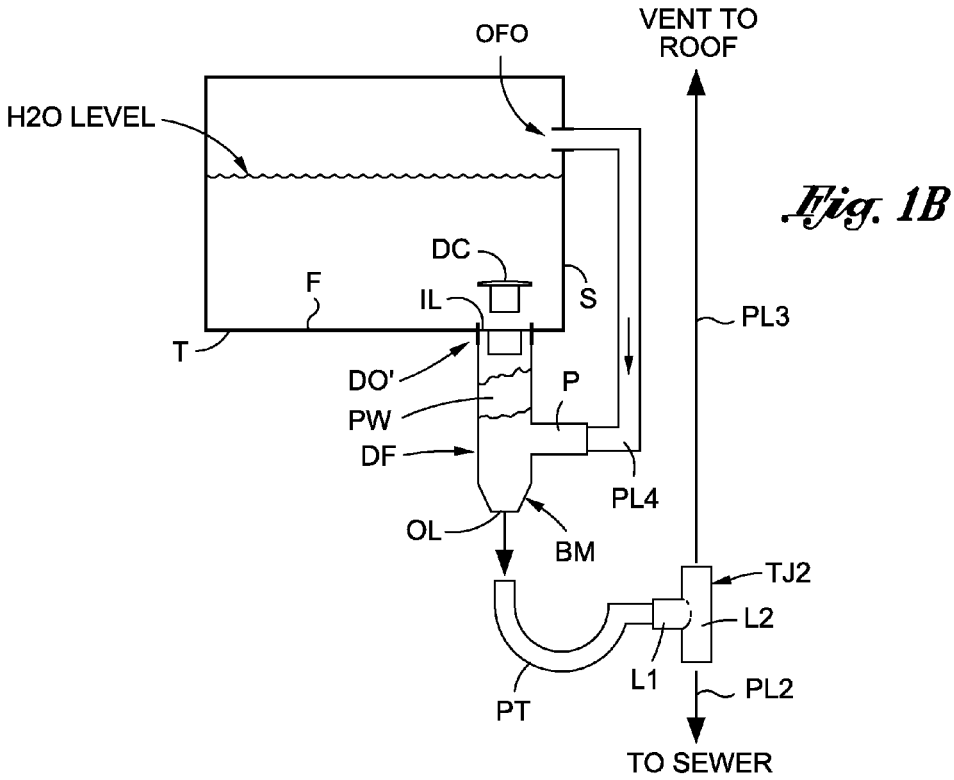
FIG. 1B is a schematic diagram illustrating my plumbing system for a tub.

As illustrated in FIG. 1B, my plumbing system has my drain fixture DF connected beneath the tub's floor F at the drain opening DO' of the tub T. My drain fixture DF comprises an elongated body member BM and a drain cap member DC inserted into an exposed open inlet IL at the top end of the body member. The drain cap member DC is manually moveable between a first position allowing liquid to flow through a passageway PW in the body member BM and a second position preventing the flow of liquid through the passageway.

The body member's passageway PW extends between the open inlet IL and a downstream open outlet OL in communication with a sewer and vent in the same manner as the prior art through the P-trap PT and T-joint TJ. A pipe P is connected at one end to the body member BM between the inlet IL and outlet OL of the body member BM so the pipe is in communication with the passageway PW. Another end of the pipe P is in communication with the overflow opening OFO in the tub T to vent the passageway PW to the atmosphere, provided the $H_2O$ level in the tub T has not reached the overflow opening.

Moving the fixture's drain cap member DC between the first position and second position controls the flow of liquid through the passageway PW. The configuration of my drain fixture DF and the way it is connected to the tub T and sewer is an example of means for creating within the passageway PW a drop in pressure by venting the passageway to the atmosphere through the overflow opening OFO and concurrently placing the outlet OL of the body member BM in communication with the sewer as liquid flows through the passageway. In other words, a Bernoulli effect is created within the passageway PW so the velocity of the liquid flowing through the passageway increases as it flows through my drain fixture DF.

The following discusses one embodiment of my drain fixture DF.

FIGS. 2-10

Figure 2A:
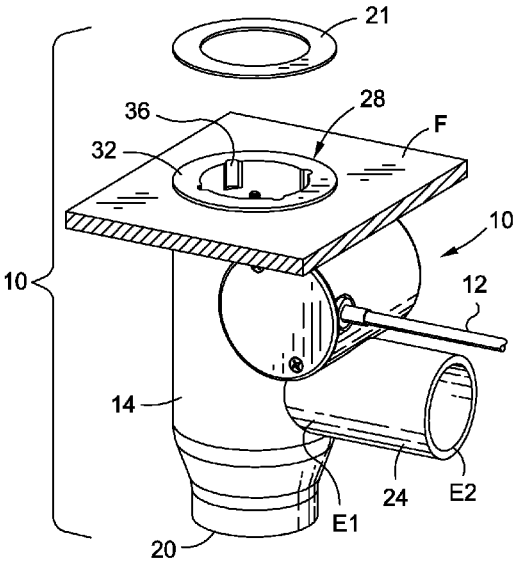
FIG. 2A is a perspective view of one embodiment of my plumbing fixture with its drain cap member removed.
Figure 2B:
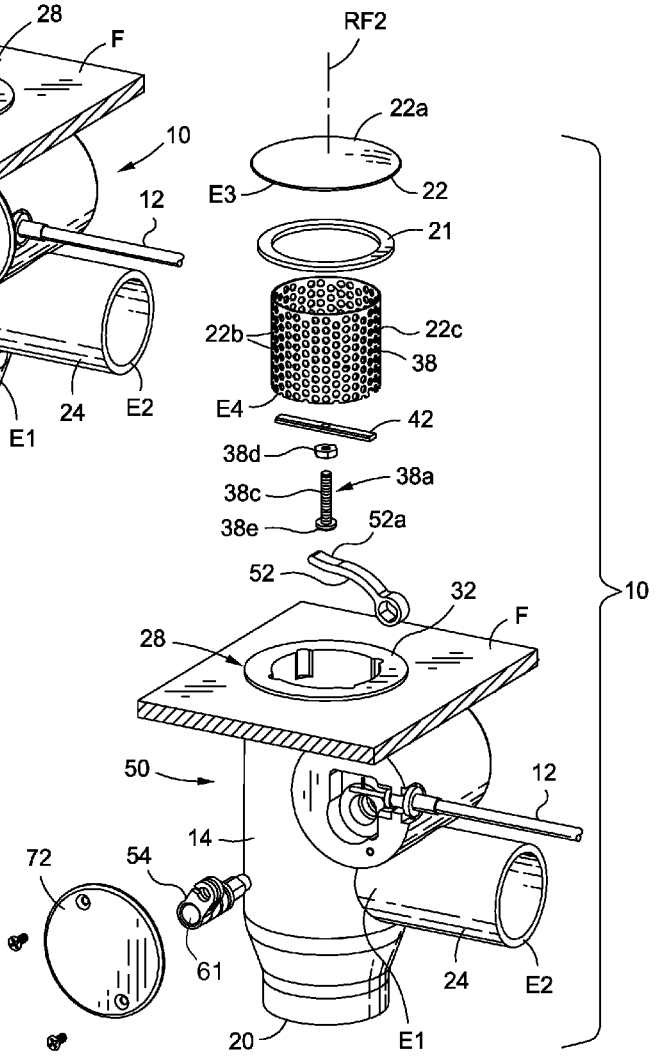
FIG. 2B is an exploded perspective view of the embodiment of my plumbing fixture shown in FIG. 2A.
Figure 2C:
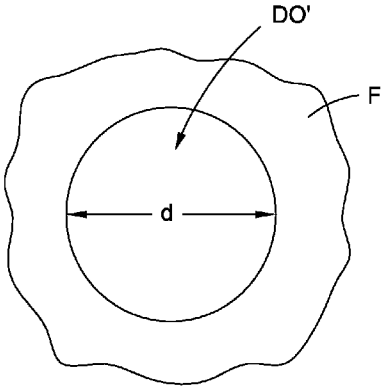
FIG. 2C is a plan view of the floor of a tub showing its drain opening.
Figure 2D:
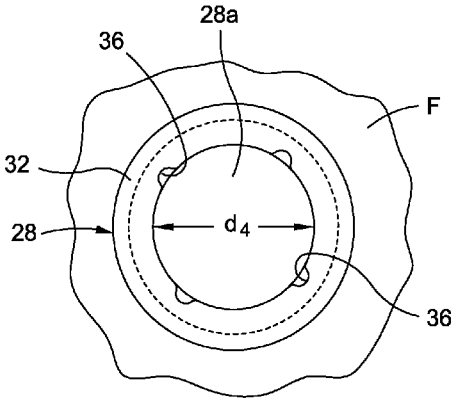
FIG. 2D is a plan view of the floor of a tub showing collar member screwed into the fixture's body member aligned with the drain opening.
Figure 2E:
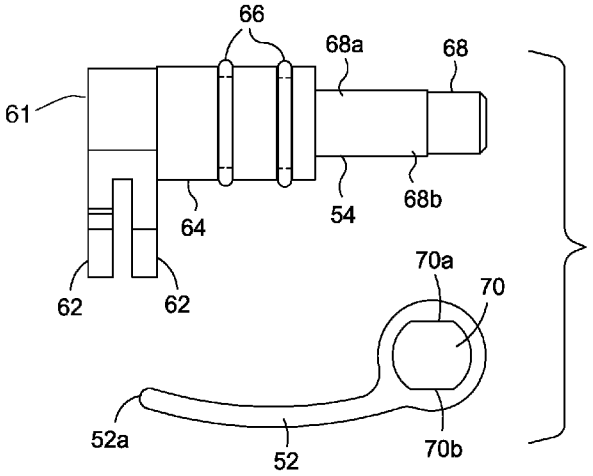
FIG. 2E is a plan view of a partially disassembled drain cap member actuator.
Figure 2F:
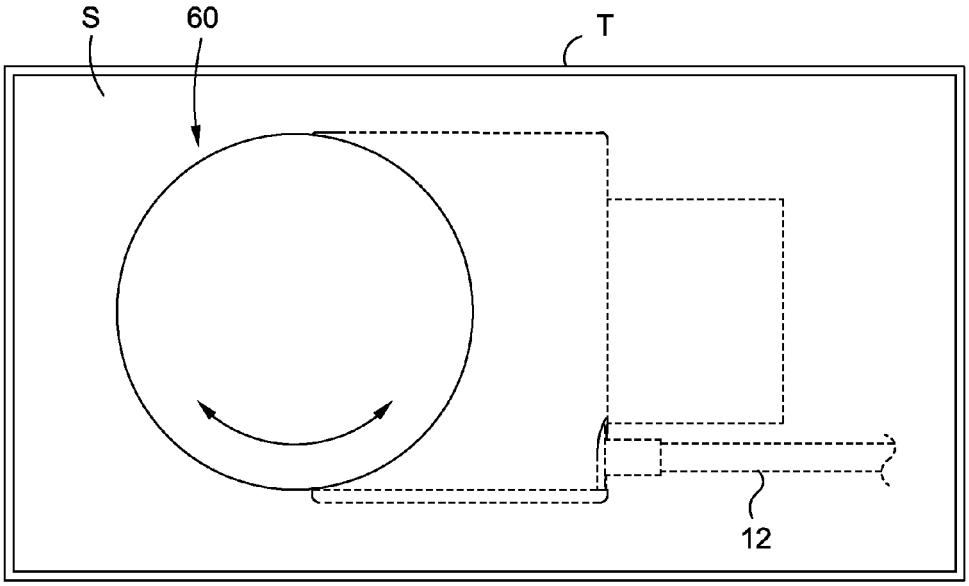
FIG. 2F is a schematic perspective view illustrating the manner in which my plumbing system is connected to a handle for opening and closing the fixture depicted in FIGS. 2A and 2B.
Figure 2F:
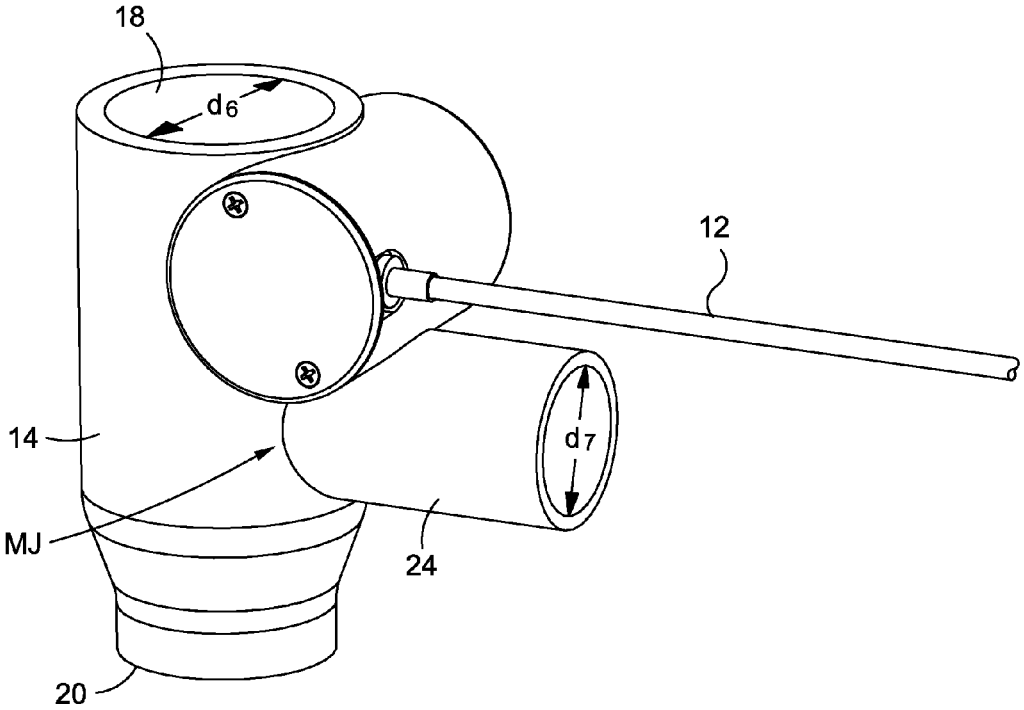
Figure 3:
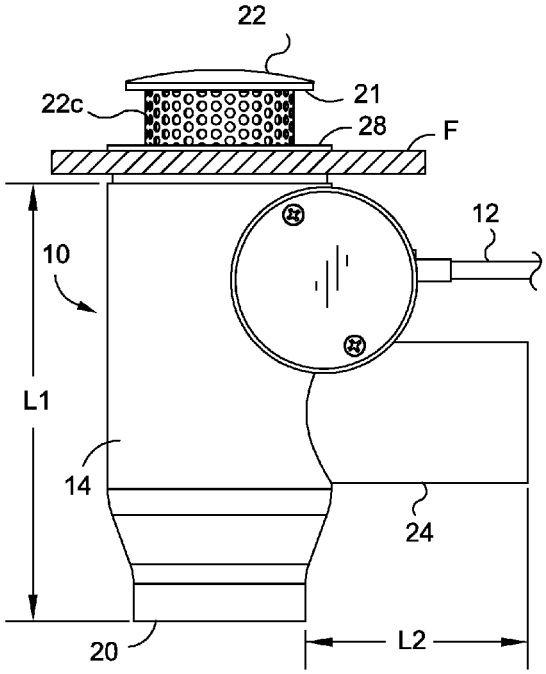
FIG. 3 is a side elevational view of the embodiment of my plumbing fixture shown in FIGS. 2A and 2B with the fixture in an open condition.

As illustrated in FIGS. 2 through 10, one embodiment my drain fixture DF is generally designated by the numeral 10 and is opened and closed using a conventional cable 12 best shown in FIG. 2F. The fixture 10 includes a body member 14 having a passageway 16 (FIGS. 5, 9 and 10) extending between an open inlet 18 and an open outlet 20. A drain cap member 22 is adapted to be inserted into the open inlet 18 and moved between an open condition (FIGS. 3-5) and closed condition (FIGS. 6-10) in response to manual actuation of the cable 12. In the closed condition that prevents liquid from flowing through the fixture 10, a circular solid cover 22*a* of the drain cap member 22 covers a drain opening DO' having a diameter d (FIG. 2C). An annular, flat rubber member 21 under the cover 22*a* provides a liquid-tight seal for the drain opening DO' when the fixture 10 is in a closed condition. In the closed condition the rubber member 21 is beneath the cover 22*a*. This rubber member 21 surrounds the open inlet 18 and bears against the fixture's top due to gravity, with the weight of the cover 22*a* and the weight of water keeping the fixture 10 in a closed condition. The water pressure against the closed cover 22*a* typically is from 520 to 1000 pounds per square inch (psi.)

Figure 5:
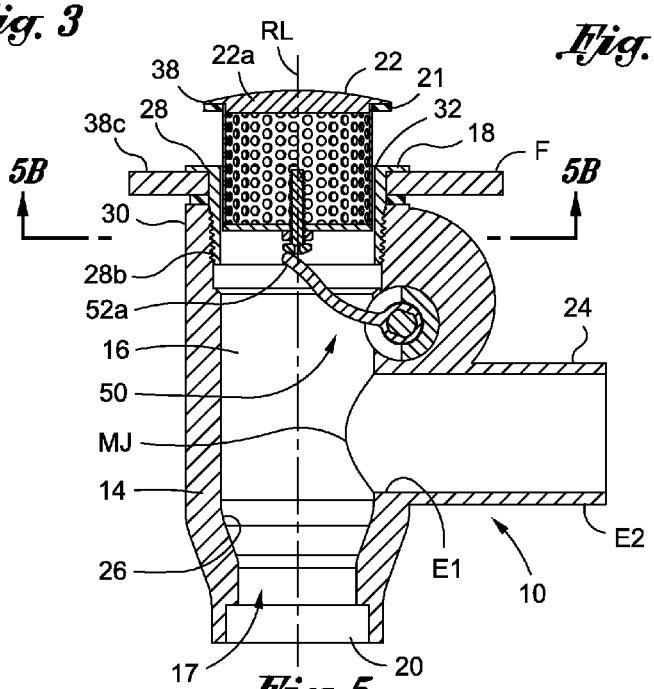
FIG. 5 is a cross-sectional view taken along line 5-5 of FIG. 4.
Figure 10:
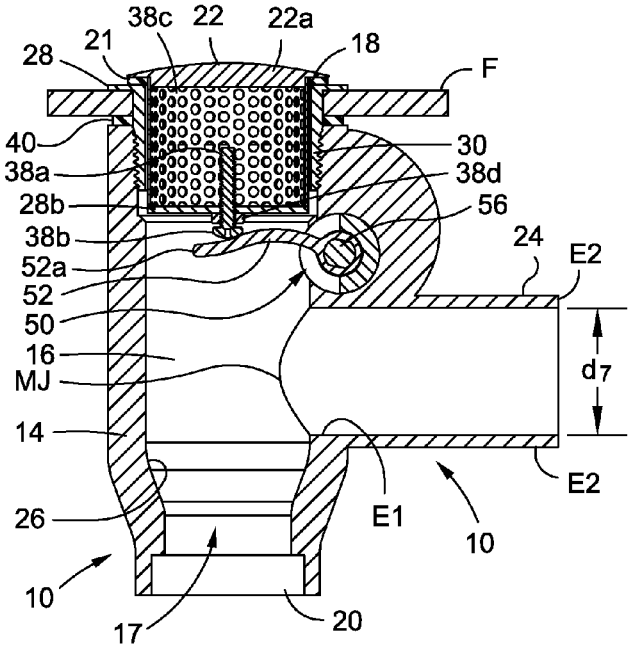
FIG. 10 is a cross-sectional view taken along line 10-10 of FIG. 7.

A pipe 24 having one end E1 connected to the body member 14 between the inlet 18 and outlet 20 is in communication with the passageway 16 at a merger junction MJ (FIGS. 5 and 10). The other end E2 of this pipe 24 is adapted to be placed in fluid communication with a tub's overflow opening OFO above the tub's floor drain opening DO' as depicted in FIG. 1B. The length $L_1$ of the body member 14 ranges substantially from 6 to 7 inches, and the length $L_2$ of the pipe 14 ranges substantially from 2.5 to 3 inches, and it has a diameter $d_7$ (FIG. 2F) that ranges substantially from 1.5 to 1⅝ inches.

Figure 6A:
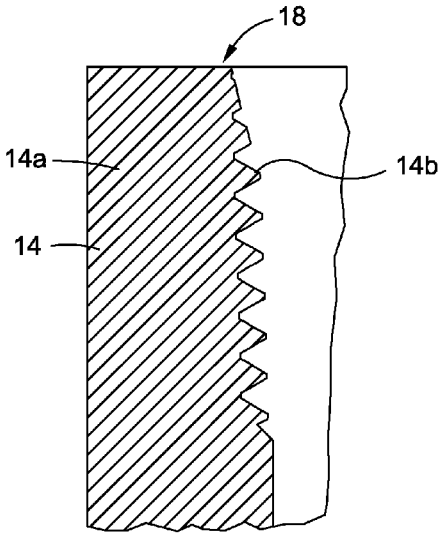
FIG. 6A is a fragmentary cross-sectional view of the top end of the body member of the fixture shown in FIGS. 2A and 2B.
Figure 9:
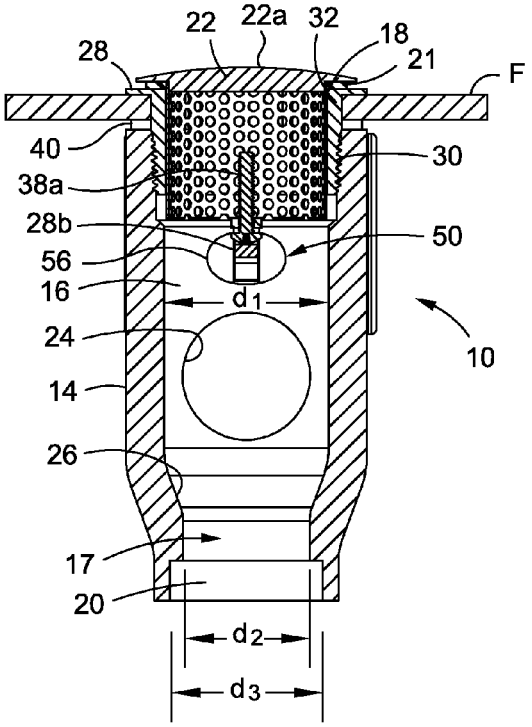
FIG. 9 is a cross-sectional view taken along line 9-9 of FIG. 6.

In the illustrated embodiment, the body member 14 and the pipe 24 may be molded from a plastic such as, for example, ABS, providing an integral, one-piece, unitary structure. The body member 14 has a central longitudinal reference line RL (FIG. 5) intersecting the inlet 18 in the top end and the outlet 20 in a tapered bottom end of the body member. As best shown in FIG. 6A, an internal surface in a sidewall 14*a* near the body member's top end or inlet 18 has internal threads 14*b*. The pipe 24 is substantially at a right angle to the body member's central longitudinal reference line RF. As best shown in FIGS. 9 and 10, a series of steps 26 along the passageway 16 near and upstream of the outlet 20 provide a restriction 17 in the passageway 16 downstream of the merger junction MJ. The series of steps 26 reduces the diameter of the passageway 16 so the upstream diameter $d_1$ is greater than the downstream diameter $d_2$ of the restriction 17 at a point below or downstream of the merger junction MJ and upstream of the outlet 20. The diameter $d_3$ of the outlet 20 is greater than the diameter $d_2$ of the restriction 17 and substantially equal to the diameter $d_1$. This enhances the Bernoulli effect created within the passageway 16 as water flows through the fixture 10. For example, the diameter $d_1$ is substantially from 2 to 2⅛ inch, the diameter $d_2$ is substantially from 1.5 to 1⅝ inch, and the diameter $d_3$ is substantially from 1⅞ to 2 inch.

Figure 5A:
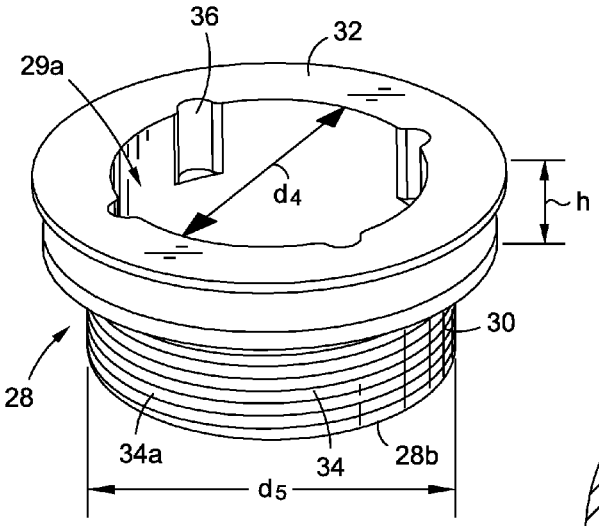
FIG. 5A is a perspective view of the collar member used in the embodiment of my plumbing fixture shown in FIGS. 2A and 2B.
Figure 5B:
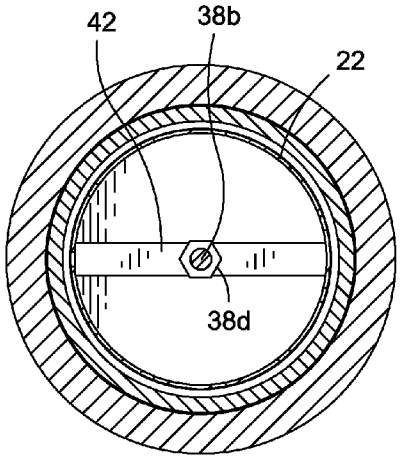
FIG. 5B is a cross-sectional view taken along line 5B-5B of FIG. 5.

As best shown in FIGS. 5 and 5A, a metallic collar member 28 in the inlet 18 receives the drain cap member 22 upon the cap member's insertion into an entrance end (FIGS. 2D and 5A) of the collar member. The collar member 28, which may be made by machining a stainless steel block, functions to retain the body member 14 affixed to the floor F of the tub T in a stationary position. A body of the collar member 28 is formed by a hollow cylindrical wall 30, which has a substantially uniform, predetermined inside diameter $d_4$ and a substantially uniform, predetermined outside diameter $d_5$. The diameter $d_6$ (FIG. 2F) of the inlet 18 of the body member 14 is essentially equal to the outside diameter $d_5$ of the collar member 28 and also equal that of the diameter d (FIG. 2C) of the drain opening DO', all of which are substantially circular like that of the cylindrical wall 30. The inside diameter $d_4$ of the collar member 28 is substantially from 2 to 2⅛ inch, and the outside diameter $d_5$ of the collar member 28 is substantially from 2¼ to 2⅜ inch. The length of the collar member 28 is less than the length $L_1$ of the body member 14. There is circumferential lip 32 around the entrance end 28*a* integral with the wall 30 that is very thin, approximately from 0.0300 to 0.0400 inch in height h (FIG. 5A). The circumferential lip 32 has a circular diameter slightly greater than the diameter of the drain cap's solid cover 22*a*. As best illustrated in FIGS. 5A, 9 and 10, the collar member 28 has on the wall 30 an externally threaded surface 34 having threads 34*a* around an open exit end 28*b* of the collar member. There are two pairs of opposed longitudinal guideways 36 (FIGS. 2A and 8) in an inside surface of the wall 30 that are interactive with a manually operated hand tool (not shown). The tool, which is used like a wrench, has fingers inserted into the guideways 36 when the tool engages the collar member 28 to tightly screw the collar member into the body member 14 as shown in FIGS. 5, 9, and 10.

As best shown in FIG. 2B, the drain cap member 22 comprises a unitary, integral one-piece, cast metal body structure 22*c*, including the cover 22*a* and a cylindrical wall member 38. Alternately, the cover 22*a* and wall member 38 may be welded together. The drain cap member 22 is detached and free to be manually lifted completely from the drain opening DO'. The cylindrical wall member 38 has at least one opening therein. For example, the cylindrical wall member may be perforated with a plurality of apertures 22*b* having a diameter substantially from 1⅞ to 2 inch. At one end E3 of the cylindrical wall member 38 is the solid cover 22*a* fixed to this end and having a circular circumference. An opposed end E4 is open so that water entering the interior of the cylindrical wall member 38 through the apertures 22*b* flows out the end E4. At the open end E4 extending across the diameter of the cylindrical wall member 38 is a rigid bar 42 (FIGS. 2B, 5B, 8 and 10) in a fixed position attached to the wall 38. The bar 42 has a right angle central bolt and nut assembly comprising a bolt 38*a* and nut each on the same side of the bar 42. The shaft 38*c* of the bolt 38*a* is aligned with the reference line RF2 (FIG. 2B) with a head 38*e* of the bolt positioned to engage but not necessarily be attached to a drain cap member actuator 50 (FIG. 5). The bolt and nut assembly allows for adjustment of the relative positions of a pivot arm 52*a* of the drain cap member actuator 50. Essentially the entire shaft 38*c* of the bolt 38*a* extends into the interior of the wall member 38. Tuning the shaft 38*c* allows the head 38*e* of the shaft to be moved relative to the pivot arm 52*a*, and then tightening the nut 38*d* so it bears against the bar 42 holds the shaft in position.

The cylindrical wall member 38 extends from an underside of the solid cover 22*a* into the passageway 16 upon insertion of the drain cap member 22 into the body member 14 through the collar member 28 that has been screwed to the body member 14. The wall member 38 has a predetermined external diameter substantially equal to the predetermined inside diameter $d_4$ of the collar member yet with sufficient clearance for the drain cap member 22 to move between a first position allowing liquid to flow through the apertures 22*b* into the passageway 16 and a second position preventing the flow of liquid. An annular seal 40 (FIGS. 9 and 10) may be lodged between the underside of the floor F and the top of the body member 14 surrounding the inlet 18 and the exterior of the hollow cylindrical wall 30 of the collar member 28. The drain cap member actuator 50 is an example of means for moving the drain cap member 22 between a first position allowing liquid to flow through the passageway and a second position preventing the flow of liquid through the passageway.

Figure 4:
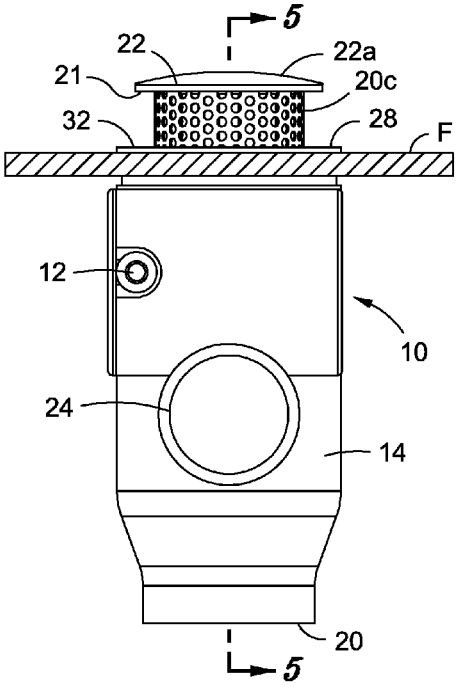
FIG. 4 is a front elevational view of the embodiment of my plumbing fixture shown in FIGS. 2A and 2B with the fixture in an open condition.

When in the raised open condition as shown in FIGS. 4 and 5, at least some of the apertures 22*b* are above the floor F, allowing water in the tub T to flow through the apertures 22*b* and out the exit end 22*b* and into the passageway 16. When in the lowered closed condition as shown in FIG. 10, all the apertures are below the floor F and the solid cover 22 overlies the drain opening DO' with the cover's underside resting against the lip 32 of the collar member 28, preventing water in the tub T from flowing through the fixture 10. Upon insertion of the drain cap member 22 into the collar member 28 in the drain opening DO', the collar member's wall 30 has a central longitudinal reference line RF2 (FIG. 2B) that is substantially co-extensive with the body member's central longitudinal reference line RL.

As best shown in FIGS. 2B, 2E, 2F, 9 and 10, the drain cap member actuator 50 for the drain cap member 22 has a portion thereof, a pivot arm 52, in the passageway 16 that engages the drain cap member 22 upon inserting the drain cap member into the passageway 16, and another portion, a rod 54 within a housing or cavity 56 in a sidewall of the body member 14 offset to a side of and next to the passageway 16 above the merger junction MJ. A handle 60 shown in FIG. 2F is mounted in a location to enable a user while in the tub T to turn the handle. One end of the cable 12 is connected to the handle 60 and the other end of the cable 12 is connected to the rod 54. For example, as best shown in FIG. 2E, the rod 54 has at one end a cylindrical recess 61 a pair of fingers 62 that hold one end of the cable 12, a central portion 64 including a pair of space apart O-rings 66, and a reduced diameter cylindrical shaft end 68 with an intermediate section with opposed flat sides 68*a* and 68*b*. The pivot arm 52 has one end connected at a right angle to the rod 54, which end has a opening 70 with opened flat sides 70*a* and 70*b* that enable the pivot arm 52 to be slipped on and off of the shaft end 68. When attached, the pivot arm 52 is in a fixed position relative to the rod 54 as the rod rotates, but may easily be detached and reattached.

Figure 6B:
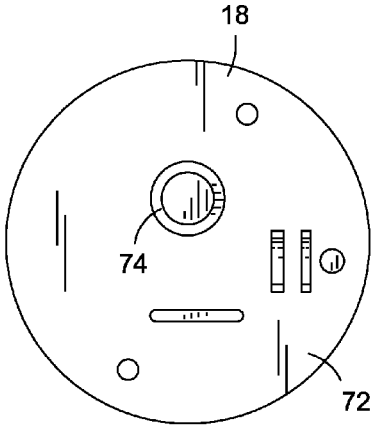
FIG. 6B is a plan view of a removable end plate forming a part of a cavity partially enclosing a drain cap member actuator.
Figure 6:
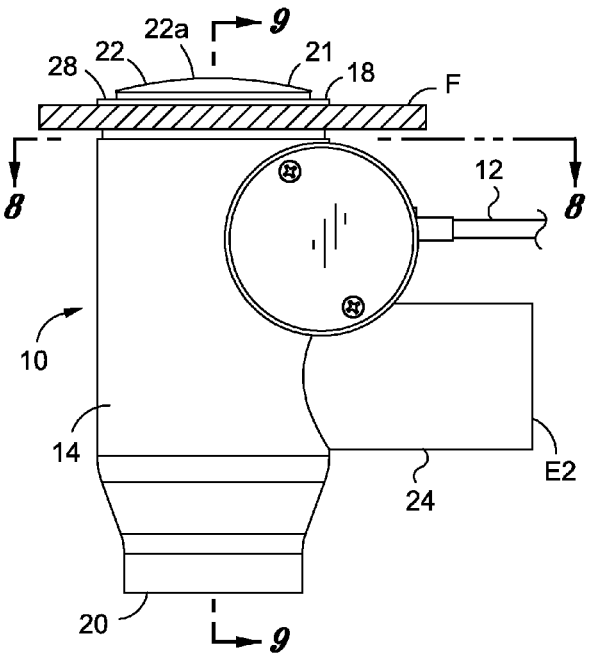
FIG. 6 is a side elevational view of the embodiment of my plumbing fixture shown in FIGS. 2A and 2B with the fixture in a closed condition.
Figure 7:
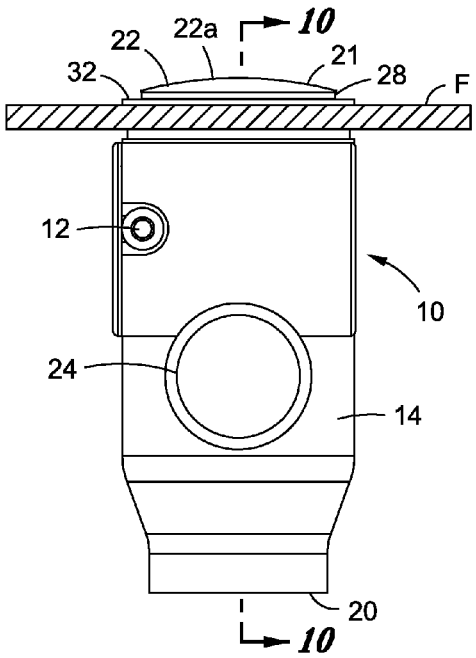
FIG. 7 is a front elevational view of the embodiment of my plumbing fixture shown in FIGS. 2A and 2B with the fixture in a closed condition.
Figure 8:
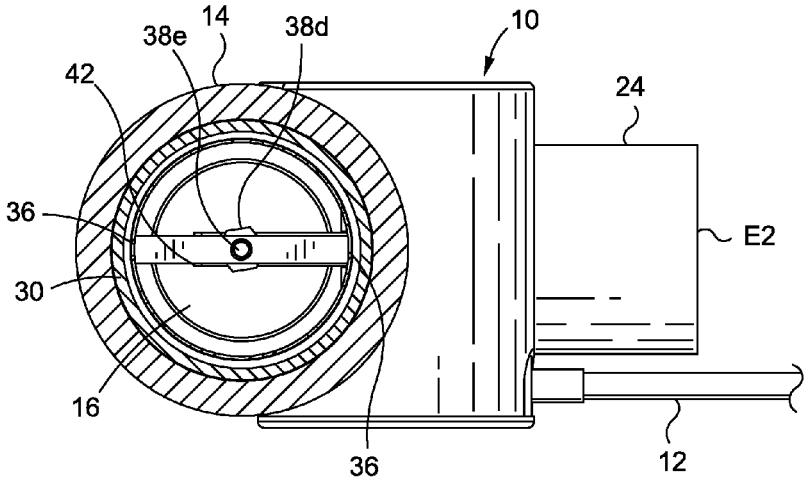
FIG. 8 is a cross-sectional view taken along line 8-8 of FIG. 6.

The cavity 56 has an open end covered by a detachable plate 72 (FIGS. 2A, 2B, and 6B) and a predetermined internal configuration to seat the rod 54 therein. An internal end of the cavity (not shown) retains one end of the rod 54 and a spindle 74 on an inside of the plate 72 retains an external end of the rod 54, so that the rod can rotate either clockwise or counter-clockwise within the cavity 56. The O-rings 66 bear against an inside wall (not shown) of the cavity so no leakage occurs of liquid flowing through the fixture 10.

An opposed free, unattached end 52*a* of the pivot arm 52 just touches a lower portion of the cap member's cylindrical wall member 38 upon insertion into the collar member 28; specifically the end 52*a* engages the head 38*e* of the bolt 38*a*. The rod 54 rotates upon rotation of the handle 60, pivoting the pivot arm 52 to move the drain cap member 22 between the open and closed conditions. If necessary to make adjustments to compensate for any dimensional errors, the bolt 38*a* and nut 38*d* are moved relative to each other to withdraw or extend the head 38*e*.

To install the fixture 10, the drain cap member 22, body member 14, and collar member 28 are initially in a disassembled state. The open inlet 18 of the body member is first positioned beneath the floor F of the tub T and aligned with the drain opening DO of the tub. The installer screws the collar member 28 into the body member's open inlet 18 so the internal threads 14*b* engage the threads 34*a* on the externally threaded surface 34 of the collar member. The collar member 28 advances into the body member 14 as the collar member and body member are screwed together until the thin lip 32 is substantially flush with the floor F. When the collar member 28 is advanced all the way into the body member 14, the opposed open exit end 28*b* of the wall 30 terminates above the merger junction MJ and the floor F of the tub T is positioned between the lip 32 and the body member's top end or open inlet 18. In other words, the body member 14 and collar member 28 are assembled with the floor F of the tub T wedged between the lip 28*a* of the collar member and the open inlet 18 of the body member to form a water tight seal so all the water exiting the tub flows through the fixture 10.

The plate 72 is initially detached to provide access to the cavity 56. The pivot arm 52 is located in the passageway 16 with the end including the opening 70 within the cavity 56. The end 68 of the rod 54 is first inserted into the open cavity 56 with its flat sides 68*a* and 68*b* in alignment with the flat sides 70*a* and 70*b* of the opening 70 pivot arm 52. The rod is advanced until its end 68 is lodged in a cylindrical recess (not shown) at the end of the cavity. The plate 72 is screwed into position to cover the open end of the cavity with its spindle 74 lodged in the recess 61 in the end of the rod 54 to rotate within set limits. Thus, the rotation of the cable 12 rotates the rod 54 within the cavity 56, turning the pivot arm 52 to raise or lower the drain cap member 22.

SCOPE OF THE INVENTION

The above presents a description of the best mode I contemplate of carrying out my plumbing fixture and system and of the manner and process of making and using them, in such full, clear, concise, and exact terms as to enable a person skilled in the art to make and use. My plumbing fixture and system is, however, susceptible to modifications and alternate constructions from the illustrative embodiments discussed above which are fully equivalent. Consequently, it is not the intention to limit my plumbing fixture and system to the particular embodiments disclosed. On the contrary, my intention is to cover all modifications and alternate constructions coming within the spirit and scope of my plumbing fixture and system as generally expressed by the following claims, which particularly point out and distinctly claim the subject matter of my invention:

The invention claimed is:

1. A plumbing drain fixture for a tub having an overflow opening in communication with the atmosphere provided the water level in the tub has not reached the overflow opening, said fixture comprising a body member including a passageway extending between an open inlet and an open outlet, said passageway having a predetermined diameter and said outlet having a predetermined diameter, and a pipe in communication with the passageway, said pipe having a first end that is connected to the body member between the inlet and outlet to form a merger junction and a second end adapted to be attached to the overflow opening in the tub to vent the passageway to the atmosphere as long as the water level in the tub has not reached the overflow opening, said passageway having therein a restriction between the merger junction and the outlet, said restriction having a predetermined diameter that is less than the predetermined diameter of the passageway and the predetermined diameter of the outlet to create a Bernoulli effect as water flows through the fixture.

2. The fixture of claim 1 where the diameter of the passageway is from 2 to 2⅛ inch, the diameter of the restriction is from 1.5 to 1⅝ inch, and the diameter of the outlet is from 1⅞ to 2 inch.

3. The fixture of claim 1 where the diameter of the outlet is equal to the diameter of the inlet and the body member has a tapered bottom end.

4. A plumbing drain fixture for a tub having an overflow opening in communication with the atmosphere provided the water level in the tub has not reached the overflow opening, said fixture comprising a body member including a passageway having a central longitudinal reference line and extending between an open inlet and an open outlet, said passageway having a predetermined diameter and said outlet having a predetermined diameter, and a pipe in communication with the passageway, said pipe being at a right angle to the central longitudinal reference line and having a first end that is connected to the body member between the inlet and outlet to form a merger junction and a second end adapted to be attached to the overflow opening in the tub to vent the passageway to the atmosphere as long as the water level in the tub has not reached the overflow opening, said body member and pipe being an integral, one-piece, unitary structure molded from a plastic and the pipe being at a right angle to the said central longitudinal reference line, said passageway having therein a restriction between the merger junction and the outlet, said restriction having a predetermined diameter that is less than the predetermined diameter of the passageway and the predetermined diameter of the outlet to create a Bernoulli effect as water flows through the fixture, said restriction being formed by series of steps along the passageway that reduces the diameter of the passageway.

5. The fixture of claim 4 where an end of the body member has a tapered bottom end and the diameter of the passageway is from 2 to 2⅛ inch, the diameter of the restriction is from 1.5 to 1⅝ inch, and the diameter of the outlet is from 1⅞ to 2 inch.

6. A plumbing drain fixture for a tub having an overflow opening in communication with the atmosphere provided the water level in the tub has not reached the overflow opening, said fixture comprising a body member including a passageway having a central longitudinal reference line and extending between and an open outlet and an open inlet including an internal thread, said passageway having a predetermined diameter from 2 to 2⅛ inch and said outlet having a predetermined diameter from 1⅞ to 2 inch, a cylindrical collar member having an open entrance end and an opposed open exit end, an externally threaded surface at the entrance end, and a predetermined inside diameter, said externally threaded surface of the cylindrical collar member and said body member being separate components adapted to be screwed together at the inlet of the body member upon attachment of the fixture to a drain opening in a floor of the tub, and a drain cap member being adapted to be inserted into said entrance end of the collar member and including a solid cover and a cylindrical wall member with at least one opening therein, said wall member extending from an underside of the solid cover into the passageway upon insertion of said drain cap member into the body member through the collar member screwed to the body member, said wall member having a predetermined diameter equal to a predetermined inside diameter of the collar member yet with sufficient clearance for the drain cap member to move between a first position allowing water to flow through said one opening into the passageway and a second position preventing the flow of water, said central longitudinal reference line intersecting said inlet and outlet, and, upon insertion of the drain cap member, the wall member has a central longitudinal reference line that is substantially co-extensive with the body member's central longitudinal reference line, and a pipe in communication with the passageway, said pipe being at a right angle to the central longitudinal reference line and having a first end that is connected to the body member between the inlet and outlet to form a merger junction and a second end adapted to be attached to the overflow opening in the tub to vent the passageway to the atmosphere as long as the water level in the tub has not reached the overflow opening, said body member and pipe being an integral, one-piece, unitary structure molded from a plastic and the pipe being at a right angle to the body member's central longitudinal reference line, said passageway having therein a restriction between the merger junction and the outlet, said restriction having a predetermined diameter that is less than the predetermined diameter of the passageway and is from 1.5 to 1⅝ inch and is less than the predetermined diameter of the outlet, whereby a Bernoulli effect is created as water flows through the fixture, said restriction being formed by series of steps along the passageway that reduces the diameter of the passageway.

7. A plumbing system comprising a tub having a floor with a drain opening therein and an overflow opening above the drain opening in communication with the atmosphere provided water in the tub has not reached the overflow opening, a drain fixture at the drain opening having an open condition where water within the tub flows from the tub through the drain fixture and into a sewer and a closed condition preventing the flow of water from the tub, said drain fixture comprising a body member beneath the floor and a drain cap member at an exposed open inlet of the body member, said body member including a passageway extending between the open inlet and a downstream open outlet, and a plumbing line in communication with the passageway that has one end connected to the body member between the inlet and outlet and another end in communication with the overflow opening to vent the passageway to the atmosphere provided the water level in the tub has not reached the overflow opening, a piping structure having one inlet end connected to the outlet of the body member and a air of outlet ends one outlet end connected to a vent line in communication with the atmosphere and the other outlet end connected to the sewer, a drain cap member at the inlet of the body member moveable between an open position and a closed position, a merger junction is formed at the connection between the body member and the passageway, and the passageway has therein a restriction that is downstream of the merger junction, said restriction having a predetermined diameter that is less than a predetermined diameter of the passageway upstream of the junction and that is less than a predetermined diameter of the outlet to create a Bernoulli effect as water flows through the fixture.

8. The plumbing system of claim 7 where the diameter of the passageway is from 2 to 2⅛ inch, the diameter of the restriction is from 1.5 to 1⅝ inch, and the diameter of the outlet is from 1⅞ to 2 inch.

9. The plumbing system of claim 7 where the diameter of the outlet is equal to the diameter of the inlet.

* * * * *